United States Patent [19]

Carter et al.

[11] 4,219,054

[45] Aug. 26, 1980

[54] METHOD AND APPARATUS FOR FILLING VALVE BAGS

[75] Inventors: Clarence F. Carter; Emmanuel Mechalas, both of Danville, Ill.

[73] Assignee: Carter Industries, Danville, Ill.

[21] Appl. No.: 913,541

[22] Filed: Jun. 7, 1978

[51] Int. Cl.[2] ..... B65B 1/18; B65B 1/28

[52] U.S. Cl. ..... 141/10; 53/469; 53/570; 141/68; 141/90; 141/98; 141/285

[58] Field of Search ..... 53/570, 571, 469; 141/10, 67, 68, 90, 91, 98, 119, 285, 302, 315, 317, 326; 302/20

[56] References Cited

U.S. PATENT DOCUMENTS 3,707,172 12/1972 Obara ..... 141/68 X

*Primary Examiner*—Frederick R. Schmidt

*Attorney, Agent, or Firm*—Burns, Doane, Swecker & Mathis

[57] ABSTRACT

A method and system for filling and for sealing valve bags of the type having a water activated sealing means on the interior of the filling valve. A fill spout or nozzle is provided to maintain the filling valve free from contamination by the material being dispensed into the bag. The nozzle has an air conduit that supplies air to a location adjacent the water activated sealing means during the filling operation and a water spray conduit that supplies a water spray to activate the sealing means at completion of the filling operation. A suction source is connected to the material supply passage of the nozzle and is actuated momentarily while the nozzle is being removed from the filling valve and prior to the end of the filling valve entering the water activated region of the valve in order to prevent material from falling from the end of the nozzle onto the activated portion of the sealing means. A sealing nozzle separate from the filling nozzle is also disclosed.

18 Claims, 6 Drawing Figures

METHOD AND APPARATUS FOR FILLING VALVE BAGS

BACKGROUND OF THE INVENTION

The present invention relates to the filling of valve bags with particulate material and, more particularly, to a method and apparatus including a novel fill spout for filling valve bags with particulate materials while insuring that a proper valve seal is obtained so that leakage of material through the valve is virtually eliminated.

Particulate materials are commonly packaged in bags that are made from multiple layers of paper and have a "valve" in one upper corner. The valve provides an opening through which the material is dispensed during the bag filling operation.

The valve bag is typically filled by inserting a spout or nozzle into the valve and causing material to flow through the nozzle into the bag. When the bag is full, the flow of material is halted and the nozzle is withdrawn from the valve usually by moving the bag away from the nozzle. The valve is sealed to prevent egress of the material from the bag during shipping and handling.

Various techniques have been used to seal the valve. These techniques depend somewhat on the type of materials being packaged and the type of valve employed. For example, U.S. Pat. No. 3,192,967 to White, Jr. et al discusses a "tuck-in" valve that extends outwardly beyond the side of the bag and is folded inwardly to seal the bag. Also discussed in the White, Jr. et al patent is a commonly used interior or insert sleeve valve that collapses to provide a seal when the valve is filled and the nozzle is removed. White, Jr. et al attempt to obtain a good seal with these types of valves by using a vacuum source to draw air through a conduit in the nozzle as the bag is withdrawn from the nozzle to remove the nozzle from the valve. This action is intended to remove material from the interior of the nozzle and from the valve so that the valve will seal properly. In U.S. Pat. No. 3,083,780 to Swenson also relating to the filling of bags with tuck-in valves or glued interior valves, steps are also taken to remove material from the valve before removal of the bag from the nozzle, but this material removal is effected by blowing the material in the nozzle into the bag prior to disengagement.

U.S. Pat. No. 4,066,108 to Lau shows another valve arrangement which is of the exterior or extended variety but is sealed by heat rather than tucking or folding. Lau attempts to provide contamination of the valve interior by the dispensed material by forming a relatively tight seal around the nozzle when it is inserted in the valve and further by inclining the bag so that the valve opening points upwardly upon removal of the nozzle and prior to sealing.

Quite frequently, a poor seal is obtained because of the presence of material in the valve at the end of the filling process despite previous attempts to minimize this problem. For example, it may be difficult or impossible to blow or suck material out of the filling nozzle by suggested prior art techniques because, with continuous suction or inward directed pressure sufficient to clear the nozzle, other undesirable side effects such as sucking material out of the bag through the nozzle or even damaging the bag may result. Thus, without an effective way to clear the nozzle at the end of each filling operation, particulate material may drop from the nozzle when it is withdrawn from the valve and material may be deposited in the valve. This deposited material then prevents the sides of the valve from properly closing against each other to form a proper seal, and material leakage through the poorly sealed valve may result.

Also, it may require several operations to fill and seal a valve bag by known techniques. For example, a filling operation performed with the bag in one position may be followed by a sealing operation with the bag moved to another position as is described in Lau U.S. Pat. No. 4,066, 108 or in Swenson U.S. Pat. No. 3,083,780. It will be appreciated that such a system for filling and sealing bags, in addition to requiring two operations and the attendant equipment, may be subject to poor sealing since material may enter the valve from the end of the filling nozzle when the bag is moved to the sealing position and the nozzle emerges from the valve. This may be a particular problem in a glued sleeve sealing system such as that shown in the Swenson patent in which the bag is moved through a considerable distance and then the glue on the interior valve is sprayed with water without any prior cleaning of the valve surface.

OBJECTS AND BRIEF SUMMARY OF THE INVENTION

It is accordingly an object of the present invention to provide a novel method and apparatus for filling valve bags with particulate material, which method and apparatus overcome the foregoing and other problems associated with prior art systems.

It is another object of the present invention to provide a novel method and apparatus for sealing valve bags while preventing material from remaining in the valve prior to sealing.

It is yet another object of the present invention to provide a novel method and filling system for valve bags wherein the bag is filled rapidly through a nozzle inserted into the valve of the bag with minimal air entrainment and the valve is maintained in a clean condition during filling and upon removal of the nozzle so that a proper seal can be made when the filling nozzle is removed from the valve.

It is yet a further object of the present invention to provide a novel method and apparatus for sealing an interior filling valve of a valve bag having a water activated sealing means on an interior surface of the valve.

It is still a further object of the present invention to provide a novel method and system for supplying a water spray to the interior surface of a filling valve having a water activated sealing means on an interior surface of the valve.

The present invention accomplishes the foregoing objects and advantages through the provision of a novel filling and sealing method and apparatus for valve bags particularly of the type having a water activated sealing means such as a dry glue or a water soluble plastic liner or an interior surface of the filling valve. In accordance with one embodiment of the invention, an elongated filling nozzle for insertion into the interior of a valve bag through the filling valve has a material passage for the introduction of particulate material into the interior of the bag. With the filling nozzle in a filling position, i.e., inserted through the filling valve, first and second conduits extend from outside the filling valve to a position within the filling valve adjacent the water activated sealing means to supply, respectively, air under pressure to free the water activated sealing means from contamination by the particulate material and a water spray to activate the sealing means on completion of a filling operation.

In one specific embodiment, the elongated filling nozzle has a cavity in a peripheral surface thereof at the position adjacent the sealing means. First and second conduits provide communication from outside the valve bag to the cavity to supply air under pressure and a water spray to the cavity.

In another embodiment, the valve bag is filled and the filling nozzle is removed. An elongated sealing member is then inserted into the valve at least to a position adjacent the sealing means and air under pressure is introduced through a first conduit to free the sealing means from contamination by particulate material. A water spray is then introduced at the position adjacent the sealing means through a second conduit in order to activate the sealing means.

BRIEF DESCRIPTION OF THE DRAWINGS

The foregoing and other objects and advantages are accomplished in accordance with the invention as will become apparent to one skilled in the art to which the invention pertains from the following detailed description when read in conjunction with the appended drawings in which.

DETAILED DESCRIPTION

Figure 1:
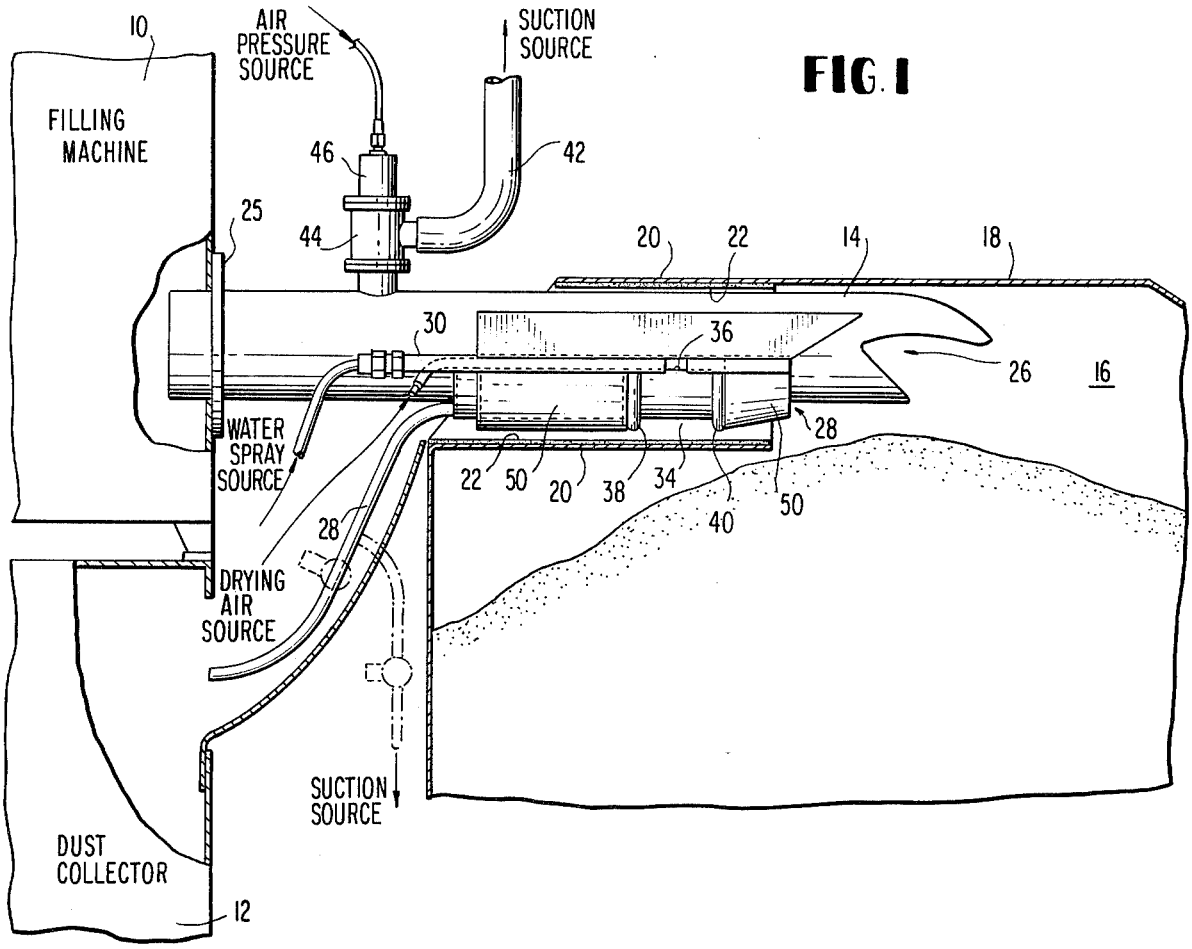
FIG. 1 is a view in elevation schematically illustrating the present invention in use filling valve bags having a water activated sealing means in the filling valve of the bag.

Referring now to FIG. 1, the present invention may be used with a suitable conventional filling machine generally indicated at 10 which typically induces a suitable conventional dust collector 12. Particulate material is supplied through a filling nozzle 14 on the filling machine 10 to the interior 16 of a valve bag 18. The filling nozzle is inserted through a filling valve 20 at the upper side portion of the bag.

The supply of material from the filling machine 10 may be either through forced flow, i.e., by introducing the fluid through the nozzle under pressure, or by what is referred to as fluid flow, i.e., where the material flows by the force of gravity but is assisted by air jets in the vicinity of the nozzle. In a typical machine of the type illustrated, the valve bag rests on a platform (not shown) which is movable so as to move the bag and cause the nozzle 14 to be inserted a predetermined distance into the bag (i.e., so that the end of the nozzle extends beyond the end of the valve as illustrated). Accordingly, reference hereinafter to insertion and removal of the filling nozzle 14 into and from the filling valve 20 of the valve bag, or insertion through the valve, is intended to encompass the discussed conventional technique as well as any other suitable technique for such insertion and removal of the nozzle.

In accordance with the present invention, the valve 20 is provided with a water activated sealing means on an interior surface thereof so that when this sealing means is activated by the application of water thereto, the opposing surfaces of the interior of the filling valve will adhere to each other when the nozzle is removed. This water activated sealing means 22 may comprise a dry glue as shown in the referenced Swenson patent but preferable comprises a water soluble plastic liner known commercially as a "Solu-Seal" (trademark) liner. The surface of such a liner, when activated by water, dissolves and becomes tacky, and the tacky surface adheres to and forms a tight seal when brought in contact with other surfaces such as an opposing surface of the liner.

The nozzle 14 of the preferred embodiment of the invention includes an elongated member 24 that extends between the particulate material source in the filling machine 10 and the interior of the valve bag 18 beyond the interior extremity of the filling valve 20 when the valve bag 18 is in a filling position as illustrated in FIG. 1. The elongated member 24 has a material passage 26 extending entirely therethrough for the introduction of the particulate material into the interior of the bag from the filling machine 10. The nozzle 14 also has a conventional vent conduit 28 disposed along the lower periphery thereof. The vent conduit 28 has an open end adjacent the discharge end of the nozzle 14 and extends between the interior of the valve bag 18 and the exterior thereof adjacent the dust collector 12. The vent conduit 28 allows air to freely escape from the interior of the valve bag during a filling operation.

In accordance with the illustrated embodiment of the filling spout of the present invention, the elongated member is a hollow tube with a flange 25 for connection to the filling machine frame, and the interior of the tube forms the material supply passage. Two sets of first and second conduits 30,30', and 32,32' extend along the member 24 on opposite sides thereof and communicate between the exterior of the valve bag and a cavity 34. The conduits are connected to the member 24 by welding or by other suitable techniques. The cavity 34 is formed along the peripheral surface of the nozzle 14 at a location adjacent the water activated sealing means 22 on the interior surface of the valve 20.

The conduits 30,30' lead from a water spray source (described hereinafter in detail) outside the valve bag to spray nozzles 36,36' within the cavity 34 on opposite sides thereof. The conduit 32 extends between a source of drying air outside the valve bag to conduits 38 and 40 that curve radially around the member 24 through an angle of about 180° and form the forward and rearward edges of the cavity 34. The conduits 38 and 40 have a number of holes spaced therealong to form air jets to direct air into the cavity as will be described hereinafter in greater detail.

It should be understood that the various supply passages (conduits) for air and water spray, as well as the cavity 34, may be formed in the nozzle in any other suitable manner (e.g., by machining). Thus, reference to the conduits disposed along the elongated member is intended to encompass conduits that are within the member or formed as part of the member or other like arrangements that provide the disclosed functions of these conduits and the cavity.

Figure 2A:
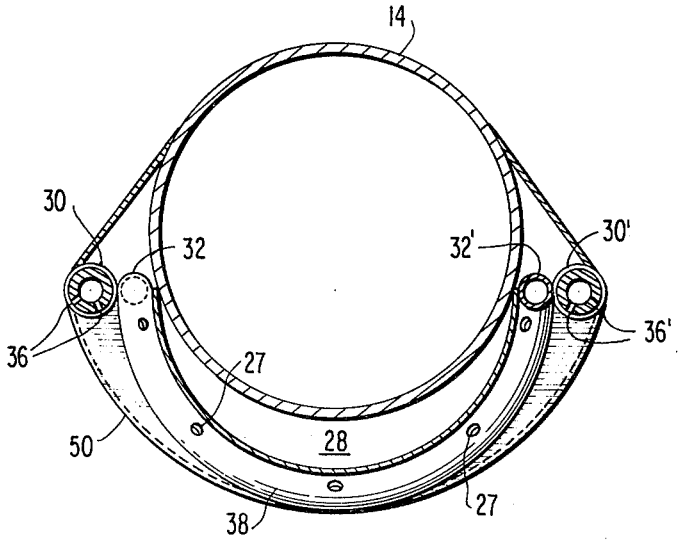
FIG. 2A is a view of the filling nozzle of FIG. 2 taken along the line A—A.
Figure 2:
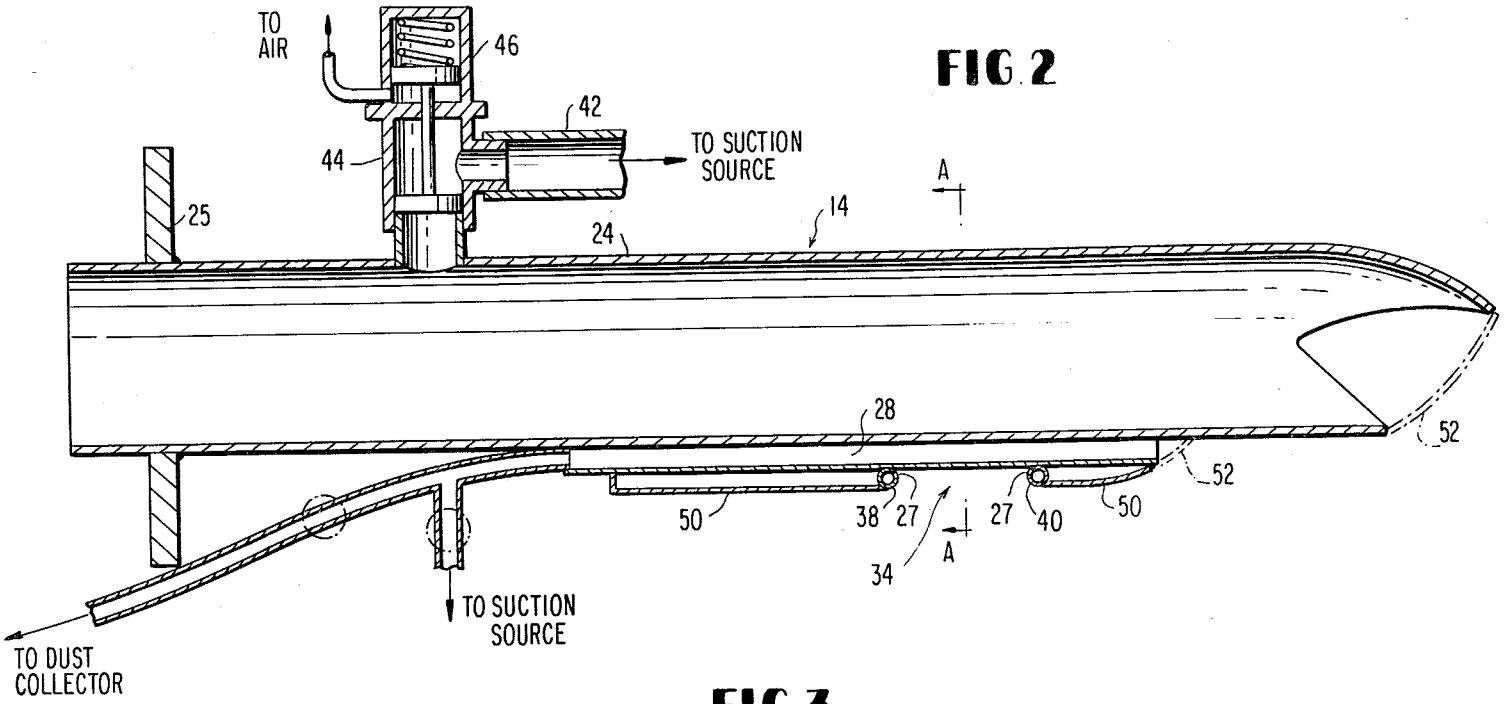
FIG. 2 is a more detailed view in elevation and in cross section of a preferred embodiment of the filling spout or nozzle of FIG. 1.

To prevent material from falling from the end of the nozzle 14 into the valve upon removal of the nozzle from the valve, a suction conduit 42 connected to a suction source (e.g., drawing a vacuum of about 40 inches of water) may communicate with the material supply passage 26 through a valve 44 controlled by an air piston 46 as is shown more clearly in FIG. 2. The valve 44 is preferably controlled to apply suction to the passage 26 for a very short period of time during removal of the nozzle from the filling valve to move material in the nozzle away from its discharge end as will be subsequently described.

In operation, particulate material is forced by gravity fluid flow or pressure through the passage 26 in the nozzle 14 into the interior of the valve bag 18. During the filling operation, air within the bag 18 vents through the conduit 28 to the vicinity of the dust collector 12 and any dust in the air is collected. When the valve bag is full as is conventionally determined by weight or other suitable measure, the flow of particulate material through the nozzle 4 is halted, usually by a suitable pinch valve (not shown).

During the filling operation, preferably as long as material is being supplied through the passage 26, air is continuously supplied from a suitable drying air source through the conduits 32 and 32' to the respective conduits 38 and 40, which in turn direct the air into the cavity 34 from the front and rear edges thereof. The cavity 34 extends around the periphery of the nozzle 14 throughout approximately 180° and the conduits 38 and 40 provide air jets along the entire extent of the forward and rearward edges of the cavity as will be seen hereinafter. Air is preferably continuously supplied to the conduits 38 and 40 by way of the conduit 32 during the entire filling operation so that the cavity 34 is at a positive air pressure with respect to the interior pressure of the bag 16 during the entire filling operation. The air supplied to the cavity 34 keeps the valve 20 dry in the vicinity of the cavity in the event that water is present from a previous filling operation. Moreover, the air supplied to the cavity leaks from the cavity across its peripheral edges causing air flow away from the cavity between the filling valve and the nozzle at least in the vicinity of the cavity. Some positive air flow will thus be created along the surface of the filling valve toward the interior of the bag, thus preventing particulate material from entering the valve and contaminating the valve in the vicinity of the cavity 34. Also, this air flow apparently creates a verturi effect that holds the valve surface against the edges of the cavity 34, creating a seal around the cavity.

When the valve bag is full, an air and water mixture is forced through the conduits 30,30' to the spray nozzles 36,36' on the opposite sides of the nozzle 14. This air and water mixture is sprayed into the cavity 34 against the water activated sealing means 22. The drying air is preferably left on during this spraying operation and the water spray is further dispersed over the sealing means surface by the drying air supplied through the conduits 38 and 40. The water activated sealing means 22 is thus activated so that it will adhere to the upper surface of the valve and form a tight seal when the nozzle 14 is withdrawn or otherwise removed from the filling valve 20. In this connection, a pressure pad (not shown) may be brought into contact with the top of the bag over the water activated area of the valve to force the opposing surfaces of the valve interior together.

It may be desirable to cut off the flow of drying air immediately prior to removing the nozzle from the filling valve in order to prevent the filling valve from being held in contact with the nozzle by the previously mentioned venturi effect during the removal of the nozzle from the valve. Accordingly, a valve may be provided in the drying air line to cut off drying air to the conduits 32,32' when the removal operation begins.

Moreover, it will be appreciated that a quantity of the material will remain in the nozzle 14 adjacent the end of the nozzle and will be subject to dropping from the end of the nozzle if there is any vibration thereof during the removal operation. Accordingly, as the nozzle is being removed and at a point at which it has been moved approximately one or two inches so that the end thereof is not in contact with the material in the bag, the air cylinder 46 is actuated to connect the interior of the filling nozzle (i.e., the material fill passage) to the suction source through conduit 42 for a period of time sufficient to move the particulate material in the nozzle back away from the discharge end thereof. It will be appreciated by one skilled in the art that this time period will vary depending on the material being dispensed, the value of the suction applied, the size of the suction conduit, and similar considerations. It is contemplated, however, that this time period will be set at less than one second and perhaps as low as 0.1 second.

In this manner, particulate material is moved away from the end of the nozzle without sucking material out of the bag. The material therefore will not drop from the discharge end of the nozzle onto the water activated surface of the sealing means as the nozzle is removed from the filling valve.

In a similar connection, the vent 28 may accumulate a quantity of material in the end thereof that extends into the interior of the valve bag adjacent the discharge end of the nozzle. Accordingly, a valve in the vent conduit 28 may be closed and a second valve opened when the air cylinder is actuated in order to momentarily connect the suction source to the vent conduit 28 and similarly move any material therein away from the end of the conduit 28 that is within the valve bag (as shown in phantom in FIG. 2).

Figure 3:
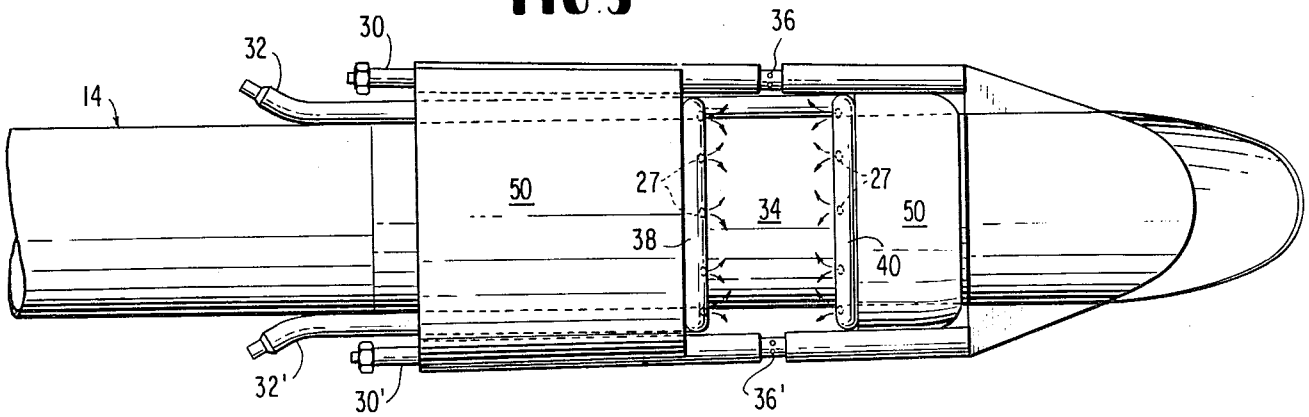
FIG. 3 is a bottom plan view of the filling nozzle of FIG. 2.

FIGS. 2, 2A and 3 illustrate the preferred embodiment of the nozzle in greater detail to facilitate an understanding of its construction and operation. Referring now to FIG. 2, it can be seen that the nozzle 14 is generally of hollow, tubular construction and is slightly tapered with a smooth, rounded discharge and for easy entry into the filling valve. The conduits for the air and water mixture and the drying air run along the exterior surface of the nozzle and are covered with suitable baffles or deflectors 50 (FIG. 3) in order to form a smooth somewhat oval surface that inserts easily into the filling nozzle of the valve bag and generally conforms to its shape. Suitable rods 52 may additionally be provided at the front end of the nozzle across both the material passage opening and the vent opening in order to prevent these openings from snagging on the filling valve as the nozzle is inserted.

It can be seen that the cavity 34 is formed by the conduits 38 and 40 as they wrap around the periphery of the nozzle. The conduit 38 is supplied with drying air by the conduit 32 running along one side of the nozzle and the conduit 40 is supplied with drying air by the conduit 32' running along the other side of the nozzle. Similarly, the water spray nozzle 36 is supplied with an air and water mixture by the conduit 30 and a water spray nozzle 36' on the other side of the nozzle is supplied by a conduit 30' running along the other side of the nozzle.

The water spray nozzles are formed in any suitable conventional manner, as by capping the conduits 30,30' where they end in the vicinity of the center line of the cavity 34 and providing an orifice of about 0.04" that directs water downwardly into the cavity toward the water activated sealing means on the interior of the filling valve. It can also be seen that the drying air jets may be formed in the conduits 38 and 40 by similarly drilling holes therethrough at locations that direct drying air into the cavity 34, preferably at a slightly upward angle.

In addition, it should be noted that the vent 28 may be of any suitable shape and is preferably of sufficient size to permit air to freely vent from the interior of the bag as it is being filled. In this connection, an elongated vent as illustrated in FIG. 2A may be provided.

Each of the conduits 30,30' is connected to its own water spray source in the illustrated embodiment. In this regard, the water spray sources are preferably constructed so that air normally flows through the conduits 30,30' at all times (or is at least controllable independently of water flow) and a measured amount of water is introduced into this air stream at the time it is desired to activate the water activated sealing means. A preferred form of a water spray source that provides independently controllable air flow with controlled, intermittent water spray is illustrated in FIG. 4.

Figure 4:
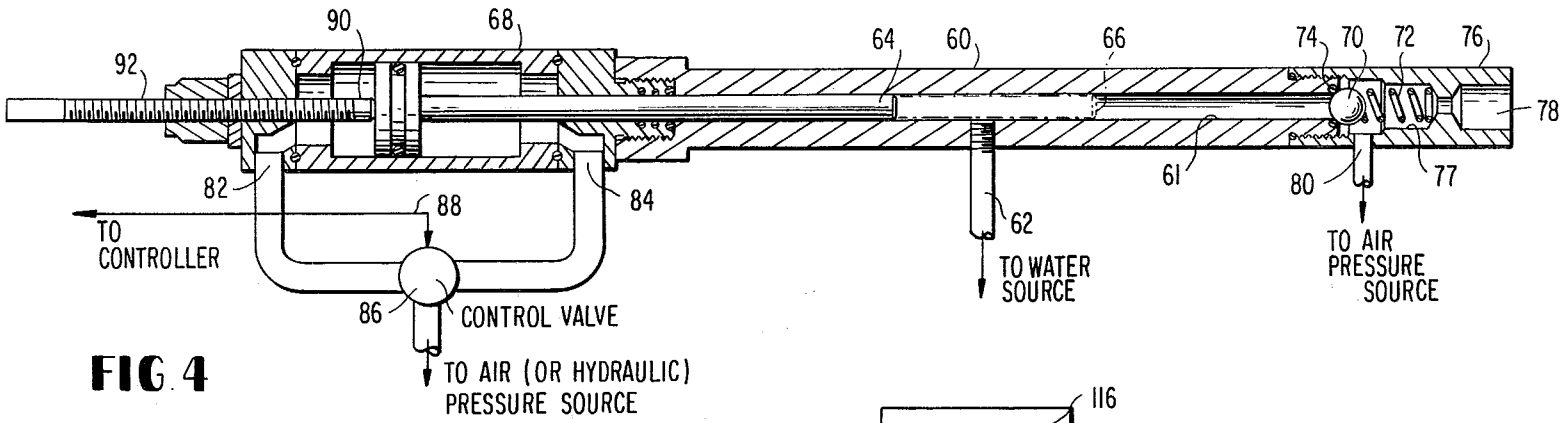
FIG. 4 is a view in elevation and in cross section of a preferred embodiment of a water spray source for activating the water activated sealing means according to the invention.

Referring now to FIG. 4, the water spray source includes a water cylinder 60 that is connected to a water source at 62. Within the cylinder 60 at one end is a piston 64 controlled between an extended position (indicated in phantom at 66) and the illustrated retracted position by an air piston 68. At the other end of the cylinder 60 is a ball valve 70 that is biased by a spring 72 against a sealing ring 74 so that the interior chamber 61 of the cylinder 60 is normally sealed with sufficient biasing force that there is no leakage of water from the chamber 61 under the action of normal water pressure of the water source.

The cylinder 60 is provided with coaxial extension 76 with an interior bore 77 that extends beyond the valve 70 and includes an outlet port 78. A source of air pressure is connected to communicate with and provide air to the bore 77 at 80 as illustrated. Air introduced at 80 flows through the bore 77 and exits at the outlet port 78, which port is connected to one of the water spray conduits 30,30' (FIG. 2).

Air for control of the air cylinder and piston 68 is introduced at two ports 82 and 84. A suitable conventional control valve 86 receives air under pressure from a suitable source as illustrated and selectively applies the compressed air to one or the other of the ports 82 and 84 as conventionally directed by a signal supplied electrically or hydraulically at control line 88. It will be appreciated that introduction of air through the port 82 will cause the piston 64 to be moved to its extended position, while the directing of air through port 84 will cause the piston 64 to be retracted. In this latter connection, an adjustable stop 90 is provided with a threaded barrel 92 to adjustably control the extent of retraction of the piston 64 and thus control the size of the chamber 61 and the amount of water it will accept from the water source.

In operation, air is supplied at 80 and flows through the bore 77 to the outlet port 78 and through one of the conduits 30,30'. Air may be thus supplied continuously during a filling operation (including during the time in which the nozzle is being retracted and a new bag is being placed in the filling position) or a valve (not shown) in the air line 80 may be selectively operated to shut off air flow during selected periods (e.g., as the nozzle is being removed).

Water is supplied to the chamber 61 of the cylinder 60 so that the chamber is full prior to initiation of a water spray to activate the sealing means in the filling valve. In this regard, water may be continuously supplied to the chamber 61 or a valve (not shown) in the line 62 may be closed immediately prior to and during the water spray period (i.e., when the piston 64 is extended) to prevent the egress of water through line 62 under the action of the piston 64.

As was previously mentioned, the stop 90 is set at a desired position in order to calibrate the effective size of the chamber 61. Accordingly, when the air piston 68 is actuated to extend the piston 64, a measured amount of water is forced through the ball valve 70 into the air stream flowing through the bore 77.

There may be some situations in which it may be desirable to fill and seal the valve bag 18 in two steps. Under such circumstances, the bag may be filled by using the nozzle of FIGS. 1-3 without performing the sealing steps or by using any other suitable filling technique. When the bag is full, the filling nozzle may be removed from the filling valve and a sealing nozzle such as that illustrated in FIG. 5 may be inserted into the valve to clean and seal it.

Figure 5:
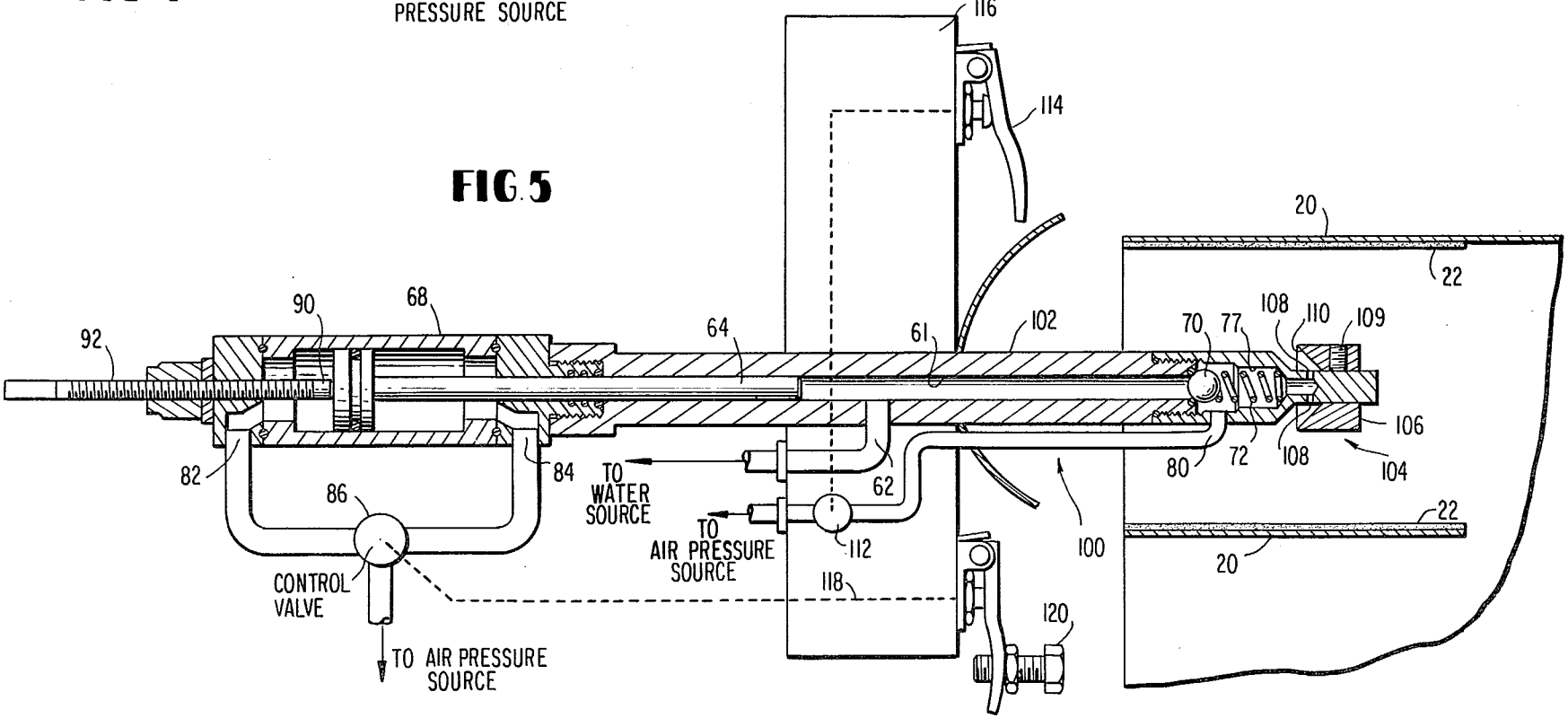
FIG. 5 is a schematic illustration in elevation of another embodiment of a sealing system for sealing valve bags having water activated sealing means in the filling valve.

Referring to FIG. 5, when the valve bag 18 is filled, the bag may be moved or merely repositioned (e.g., by tilting) to remove the filling nozzle from the valve 20. A sealing nozzle 100 may then be inserted a predetermined distance into the valve 20. The sealing nozzle is then operated to clean and activate the sealing means 22 on the interior of the filling valve.

More specifically, the sealing nozzle 100 includes an elongated member 102 that is insertable into the filling valve 20 without engaging at least that portion of the sealing means 22 that is to water activated and, in the preferred embodiment, without engaging any of the interior portion of the filling nozzle. The member 102 is constructed and operates identically to the water spray piston device described in connection with FIG. 4 except that the output end 104 of the device is not connected to an output tube or conduit as in the device of FIG. 4 but, rather, is capped and provided with a deflector 106 and output ports 108 as illustrated. Accordingly, like numerical designations have been used in FIG. 5 to indicate elements previously discussed in connection with FIG. 4.

The deflector 106 is cylindrical and is provided with a set screw 109 to attach it in a desired position relative to two or more output ports 108 that direct air and water spray against an inwardly angled, frustro-conical surface 110 as illustrated. The surface 110 deflects the air (during initial valve cleaning) and water spray (during activation of the sealing means) against the water activated sealing means on the interior of the filling valve.

A valve 112 in the air supply line to the air inlet 80 is mechanically coupled to a handle 114 on a housing or other suitable frame 116 suspended at a convenient location near the filling machine. The handle 114, when depressed by the operator, opens the valve 112 and allows air to flow to the interior bore 77 and through the outlet ports 108 where the air is deflected by the surface 110 against the interior of the valve in a direction outwardly from the interior of the bag. This air flow results in cleaning of the valve surface 22 and is accomplished as the operator is inserting the member 102 into the valve.

The valve 86 is mechanically coupled at 118 to an adjustable stop 120 located on the housing 116 at a position where it will contact the side of the filled bag. The stop is set so that it contacts the bag and opens the valve 86 automatically when the member 102 has been inserted into the valve 20 to a point at which the deflector 106 is in the vicinity of the sealing means and will deflect water emerging from the ports 108 onto the sealing means. When the stop 120 contacts the bag, its mechanical coupling causes the valve 86 to apply air to the inlet port 82 which, in turn, causes the piston 64 to be extended. As was previously mentioned, this causes a measured amount of water to be forced through the ball valve 70 into the air stream flowing through the bore 77, thus spraying the filling valve interior to activate the sealing means. The sealing device can then be withdrawn from the valve and the valve can be sealed by application of pressure to the top of the bag over the valve.

The present invention may be embodied in other specific forms without departing from the spirit or essential characteristics thereof. The presently disclosed exemplary embodiment is therefore to be considered in all respects all illustrative and not restrictive, the scope of the invention being indicated by the appended claims rather than by the foregoing description, and all changes which come within the meaning and range of equivalency of the claims are therefore intended to be embraced therein.

What is claimed is:

1. A filling nozzle for filling a valve bag with particulate material, the valve bag having a filling valve with a water activated sealing means on an interior surface of the valve, the filling nozzle comprising:

an elongated member for insertion through the filling valve and into the interior of the bag, the elongated member having a material passage therethrough for the introduction of particulate material into the interior of the bag from a location outside the bag and having means forming a cavity in a peripheral surface thereof at a position that is adjacent the interior surface of the filling valve with the elongated member inserted into the filling valve during a filling operation; and first and second conduit means along the member for providing communication from outside the valve bag to the cavity, the first conduit means comprising an air supply passage for supplying air under pressure to the cavity to free the interior surface of the filling valve adjacent the cavity from contamination by particulate material and the second conduit means comprising a water spray passage for supplying and directing a water spray against the interior surface of the filling valve adjacent the cavity.

2. The filling nozzle of claim 1 further including a third conduit means extending along the length of the elongated member to provide communication from outside the valve bag to the interior of the valve bag and to thereby provide a passage for venting air from the interior of the valve bag to outside the bag during a filling operation.

3. The filling nozzle of claim 1 wherein a material supply line containing a material control valve is connected to the material passage of the elongated member and further including a vacuum suction passage containing a vacuum control valve communicating with the material passage of the elongated member.

4. The filling nozzle of claim 3 including control means for closing the material control valve in the material supply line upon filling the valve bag with a predetermined amount of material and for momentarily opening the vacuum control valve in the vacuum suction passage upon partial removal of the elongated member from the filling valve.

5. The filling nozzle of claim 1 wherein the first conduit means is connected to an air supply that continually supplies air under pressure from the time of insertion of said nozzle into the valve at least until subsequent to the supply of said water spray through said second conduit.

6. The filling nozzle of claim 1 wherein said second conduit means is connected to water spray supply that continuously supplies air under pressure through said second conduit means, the water spray supply including means for selectively introducing a measured amount of water into the air supplied through said second conduit means.

7. In a system for filling with particulate material valve bags having a filling valve with a water activated sealing means on an interior surface of the valve, apparatus for sealing the filling valve comprising:

an elongated member for insertion into the filling valve;

first conduit means extending into the elongated member from outside the filling valve to a position in the filling valve adjacent the water activated sealing means with the elongated member inserted a predetermined distance into the filling valve, the first conduit means supplying air under pressure from outside the filling valve to said position in the filling valve adjacent the water activated sealing means in order to free the water activated sealing means at said position from contamination by the particulate material; and second conduit means extending into the elongated member from outside the filling valve to the position in the filling valve adjacent the water activated sealing means with the elongated member inserted said predetermined distance into the filling valve, the second conduit means supplying a water spray from outside the filling valve to said position in the filling valve adjacent the water activated sealing means and directing the spray onto at least one surface of the sealing means to activate the sealing means in order to form a seal between said one surface and another opposing surface of the filling valve when the elongated member is removed from insertion into the filling valve.

8. A filling spout for filling with particulate material valve bags having an elongated valve lined with a water activated sealing means comprising:

an elongated member for insertion into the valve and having a material passage therethrough for the flow of material into the interior of the valve bag, the elongated member including an exterior portion that remains outside the valve with the member inserted into the valve in a filling position, an interior portion that extends into the interior of the valve bag with the member inserted in the filling position, and an intermediate portion that extends into the valve with the member in the filling position;

first conduit means extending along the elongated member and providing a fluid passage between the interior and exterior portions of the member, the first conduit means providing an exhaust path for air within the valve bag during a filling operation; and second conduit means extending along the elongated member and providing a fluid passage from the exterior portion of the member to the intermediate portion of the member to a water spray passage at a location on the outside of the intermediate portion adjacent a surface of the water activated sealing means; and means connected to said second conduit means for producing a water spray comprising a mixture of air and water, the second conduit means delivering said water spray to said water spray passage at said location outside the member adjacent the surface of the water activated sealing means to activate said sealing means in order to seal the valve at the termination of a filling operation.

9. The spout of claim 8 including means forming a cavity at said location on the outside of the intermediate portion of the elongated member, said water spray passage being disposed to dispense said water spray within said cavity.

10. The spout of claim 9 including third conduit means extending along said elongated member and providing communication between the exterior and intermediate portions of the member to at least one air passage within said cavity.

11. The spout of claim 10 wherein said first conduit means has a vent opening spaced from the end of the interior portion of the elongated member in the direction of the intermediate portion.

12. The spout of claim 8 wherein said first conduit means has a vent opening spaced from the end of the interior portion of the elongated member in the direction of the intermediate portion.

13. The spout of claim 8 including a suction conduit connected to said exterior portion of said elongated member and communicating with said material passage.

14. A method for filling and sealing valve bags of the type having elongated valve communicating between the interior and exterior of the valve bag wherein the valve includes a water activated sealing means on an interior surface thereof, the method comprising the steps of:

inserting an elongated, generally hollow nozzle into the valve such that an exterior portion of the nozzle remains outside the valve, an interior portion of the nozzle extends into the interior of the valve bag, and an intermediate portion of the nozzle extends through the valve;

dispensing a flowable material through the interior of the nozzle into the interior of the valve bag until the valve bag contains a predetermined amount of the material;

venting air from the interior of the valve bag while dispensing the flowable material into the valve bag;

producing a water spray by mixing a predetermined amount of water with air;

delivering the water spray through a conduit along the nozzle to a water spray passage at a location on an outside surface of the intermediate portion of the nozzle after the valve bag contains the predetermined amount of material in order to discharge the water spray over a surface of the water activated sealing means and thereby activate the sealing means; and, removing the nozzle from the valve in order to seal the valve.

15. The method of claim 14 including the step of momentarily applying suction to the interior of the nozzle adjacent the exterior portion thereof after partially removing the nozzle from the valve in order to move material in the nozzle away from the end of the interior portion thereof.

16. The method of claim 14 including the step of providing a cavity in an outside surface of the intermediate portion of the nozzle, and wherein said water spray is delivered to the interior of said cavity.

17. The method of claim 16 including the step of continuously discharging air into said cavity while the material is being dispersed into the interior of the valve bag.

18. The method of claim 16 including the steps of:

discharging air into said cavity during the step of dispensing material into the interior of the valve bag; and introducing said predetermined amount of water into said discharged air prior to its discharge into said cavity to produce said water spray after the valve bag contains said predetermined amount of material.

* * * * *